313-414 SR
4/25/78 OR 4,086,513

United States Patent [19]

Evans, Jr., deceased

[11] 4,086,513

[45] Apr. 25, 1978

[54] PLURAL GUN CATHODE RAY TUBE HAVING PARALLEL PLATES ADJACENT GRID APERTURES

[75] Inventor: John Evans, Jr., deceased, late of Lancaster, Pa., by Frances Mae Evans, executrix

[73] Assignee: RCA Corporation, New York, N.Y.

[21] Appl. No.: 554,610

[22] Filed: Mar. 3, 1975

[51] Int. Cl.[2] ..... H01J 29/50; H01J 29/56
[52] U.S. Cl. ..... 313/414; 313/458
[58] Field of Search ..... 313/412, 414, 413, 409, 313/411

[56] References Cited

U.S. PATENT DOCUMENTS

| | | | |
|---|---|---|---|
| 2,609,516 | 9/1952 | Flory | 313/453 |
| 3,579,008 | 5/1971 | Miyaoka | 313/412 |
| 3,771,002 | 11/1973 | Standaart | 313/414 X |
| 3,772,554 | 11/1973 | Hughes | 313/412 |
| 3,852,608 | 12/1974 | Johannes et al. | 313/449 |
| 3,866,080 | 2/1975 | Barkow | 313/412 |

*Primary Examiner*—Robert Segal
*Attorney, Agent, or Firm*—Glenn H. Bruestle; Dennis H. Irlbeck

[57] ABSTRACT

In the tube gun, at least one of the two electrode grids nearest the screen has extensions on opposite sides of its apertures to distort an electrostatic field formed by the grid to at least partially compensate for distortion of an electron beam in the magnetic deflection field.

6 Claims, 10 Drawing Figures

PLURAL GUN CATHODE RAY TUBE HAVING PARALLEL PLATES ADJACENT GRID APERTURES

BACKGROUND OF THE INVENTION

The present invention relates to an improvement in electron guns for cathode ray tubes. The improved gun is primarily intended for use in a color tube having a line type color phosphor screen, with or without light absorbing guard bands between the color phosphor lines, and a mask having elongated apertures or slits. However, the gun improvement could be used in the well known dot-type color tube having a screen of substantially circular color phosphor dots and a mask with substantially circular apertures. The invention may also be applied to other types of cathode-ray tubes such as penetration or focus-grill tubes.

An in-line electron gun is one designed to generate or initiate at least two, and preferably three, electron beams in a common plane, for example, by at least two cathodes, and direct those beams along convergent paths in that plane to a point or small area of convergence near the tube screen.

There has been a general trend toward color picture tubes with greater deflection angles in order to provide shorter tubes. In the transition to a wider deflection tube, e.g., 90° deflection to 110° deflection, it has been found that the electron beam becomes increasingly more distorted as it is scanned toward the outer portions of the screen. Such distortions may be due, at least in part, to variations in the deflection field formed by a yoke mounted on the tube. It is the purpose of the present invention to at least partially compensate for these distortions.

Although the present invention may be applied to several different types of tubes, it is hereinafter described as an improvement on a tube having an in line gun, such as disclosed in U.S. Pat. No. 3,772,554 issued to Hughes on Nov. 13, 1973. For the purpose of gun construction and operation, U.S. Pat. No. 3,722,554 is hereby incorporated by reference. Additionally, for the purpose of yoke construction and operation U.S. Pat. No. 3,721,930 issued to Barkow et al on Mar. 20, 1973 also hereby incorporated by reference as describing a representative yoke.

SUMMARY OF THE INVENTION

A cathode-ray tube comprises an evacuated envelope, a cathodoluminescent screen within the envelope and electron gun means for generating and directing at least one electron beam toward the screen. The gun means includes at least one cathode and a plurality of apertured grids spaced between the cathode and screen. At least one of the apertured grids has extensions located on opposite sides of an aperture therein. These extensions cause distortion of the electrostatic field formed by the grid to form a noncircular electron beam.

DETAILED DESCRIPTION OF THE PREFERRED EMBODIMENT

Figure 1:
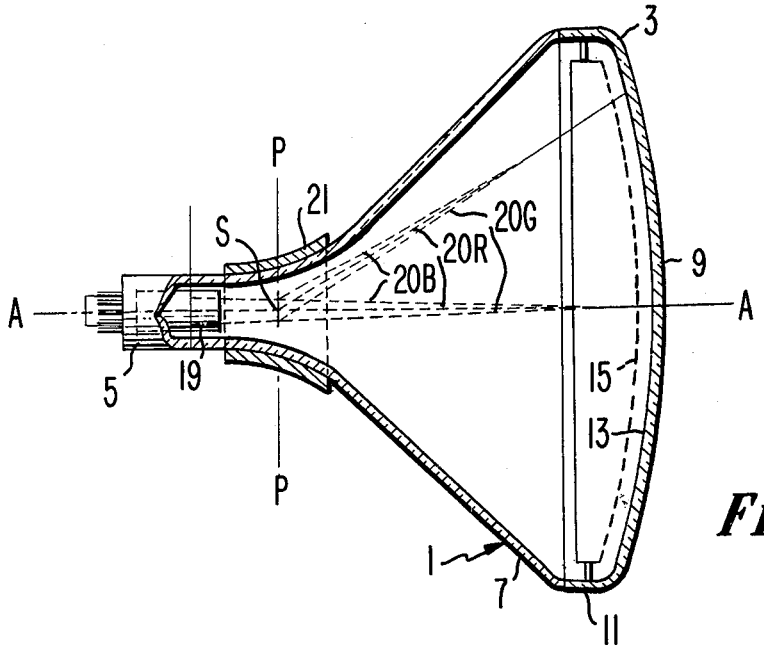
FIG. 1 is a plan view, partly in axial section, of a shadow mask color picture tube in which the present invention is incorporated.
Figure 2:
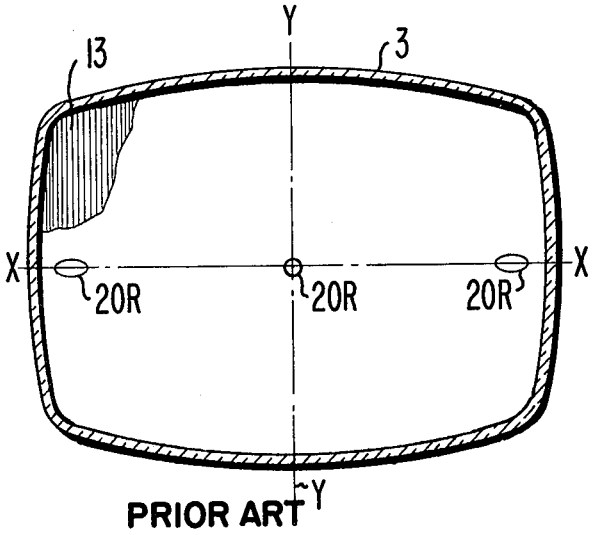
PRIOR ART FIG. 2
FIGS. 2 and 3 are schematic views showing beam spot shapes without and with the invention respectively.
Figure 3:
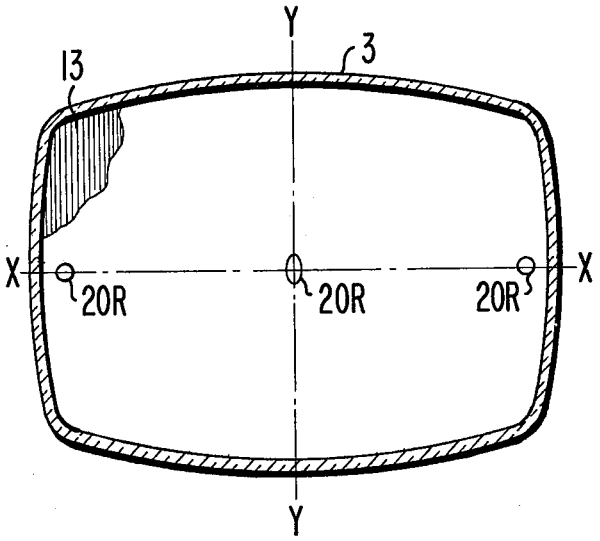

FIG. 1 is a plan view of a rectangular color picture tube, having a glass envelope 1 comprising a rectangular panel or cap 3 and a tubular neck 5 connected by a rectangular funnel 7. The panel 3 comprises a viewing faceplate 9 and a peripheral flange or sidewall which is sealed to the funnel 7. A mosaic three-color phosphor screen 13 is located on the inner surface of the faceplate 9. As shown in FIGS. 2 and 3, the screen 13 is preferably a line screen i.e., comprised of an array of parallel phosphor lines or strips, with the phosphor lines extending substantially parallel to the vertical minor axis Y—Y of the tube. A multiapertured color selection electrode or shadow mask 15 is removably mounted, by conventional means, in predetermined spaced relationship to the screen 13. An improved in-line electron gun 19, shown schematically by dotted lines in FIG. 1, is mounted within the neck 5 to generate and direct three electron beams 20B, 20R and 20G along co-planar convergent paths through the mask 15 to the screen 13.

The tube of FIG. 1 is designed to be used with an external magnetic deflection yoke 21, surrounding the neck 5 and funnel 7, in the vicinity of their junction. When appropriate voltages are applied to the yoke 21, the three beams 20B, 20R and 20G are subjected to vertical and horizontal magnetic fields that cause the beams to scan horizontally and vertically in a rectangular raster over the screen 13.

The initial plane of deflection (at zero deflection) is shown by the line P—P in FIG. 1 at about the middle of the yoke 21. Because of fringe fields, the zone of deflection of the tube extends axially, from the yoke 21, into the region of the gun 19. For simplicity, the actual curvature of the deflected beam paths 20 in the deflection zone is not shown in FIG. 1.

FIGS. 2 and 3 are views of the tube screen 13 showing electron beam spot shapes as a beam 20R strikes the screen without and with the present invention, respectively. As shown in FIG. 2, without the present invention the shape of the electron beam at the center of the screen is substantially round but has a horizontally elliptical or elongated shape at the sides of the screen. Horizontal ellipticity is defined as an ellipse having its major axis horizontal.

This elongation of the beam is undesirable because of its adverse effect on video resolution. The elongation occurs because the beam is under-focused in the horizontal dimension. By using the present invention, however, the shape of the beam at the sides of the screen is made substantially rounder or at least less elongated in the horizontal direction. The compensation that makes the beam rounder at the edges, however, may make the beam at the center of the screen vertically elongated, i.e. elliptical with the major axis of the ellipse vertical. This vertical ellipticity causes no resolution problem since vertical resolution is limited by the number of scan lines.

The horizontal ellipticity problem is one encountered with some yokes, such as the self-converging yoke disclosed in U.S. Pat. No. 3,721,930, when designed for wide-angle (e.g. 90°, 110°) deflection. Because of tube geometry, deflection yokes used with horizontally in-line circular beams and designed to produce self-convergence along the horizontal axis of the tube must have a deflection field which diverges the beams as horizontal deflection angle increases. This horizontal divergence is achieved with a yoke capable of forming an astigmatic field, that, while diverging the beams in the horizontal plane with horizontal deflection, also causes vertical convergence of the electrons within each individual beam. Taken alone, this vertical convergence of electrons in each beam has no effect on horizontal beam spacing, however, the astigmatic field also diverges or defocuses each individual beam horizontally as it converges or focuses it vertically. A typical resultant electron beam spot produced at the center of the screen on a 25V°-110° in-line tube when subjected to an astigatic field is a round spot 4.6 mm. in diameter. However, corner spots are elongated in the horizontal direction having a horizontal length of 7.9 mm. and a vertical height of 2.7 mm. The corner spot ellipticity is thus 2.9/1.0.

The horizontal dimension of the electron beam spot can be reduced by increasing the focus voltage, however, such voltage adjustment has an adverse effect on the beam in the vertical direction causing it to be over focussed vertically, thereby degrading vertical video resolution. Adjustment of the focus voltage alone does not provide an acceptable electron spot. Therefore, a change in focus voltage must be accompanied by some other means or method that will alter the shape of the electron beam. A means for providing such alteration includes providing sufficient astigmatism in the electron gun so that a focus voltage can be obtained that provides optimum focusing of the electron beam in both the vertical and horizontal directions. Such optimum focus voltage may be compromised between the ideal voltages required for perfect focusing in each of the two orthogonal directions. With focus voltage set to provide optimum focus at the edge of the screen, the undeflected spot at the center of the screen becomes vertically elongated. In effect then, the present invention is a structure which provides sufficient astigmatism in the electron gun to reduce the beam spot distortion problem at the edges of the screen caused by the yoke by providing a compensating opposite distortion in the gun in the form of a preshaping of the beam before it enters the yoke field. This preshaping involves somewhat compromising the spot shape at the center of the screen.

Figure 4:
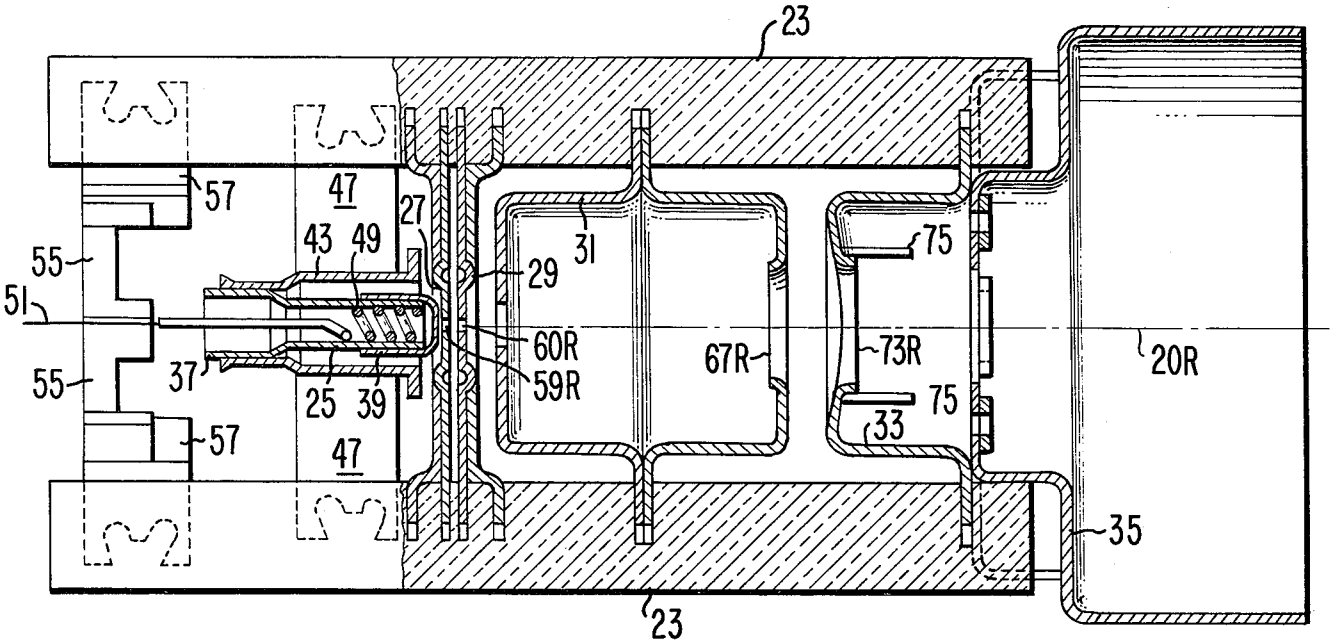
FIGS. 4 and 5 are enlarged axial section views of the electron gun shown in dotted lines in FIG. 1 taken along mutually perpendicular planes axially through the gun.
Figure 5:
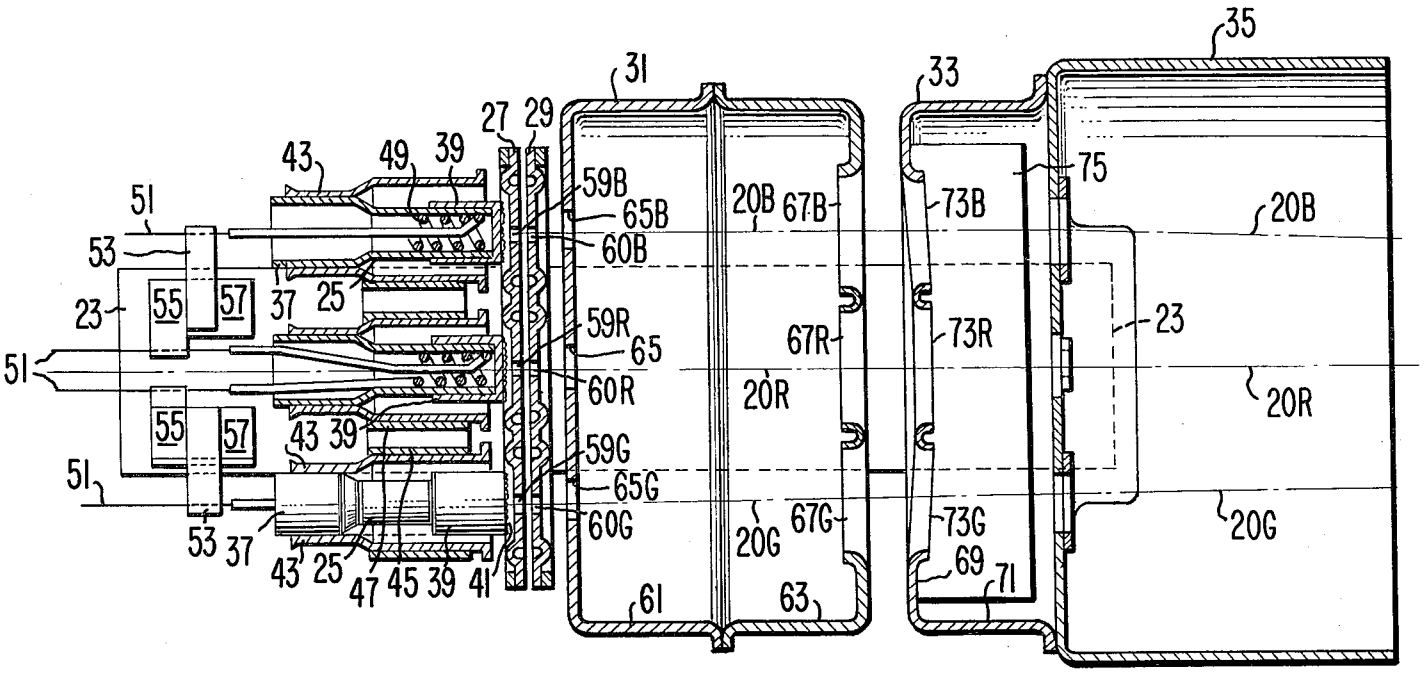
Figure 6:
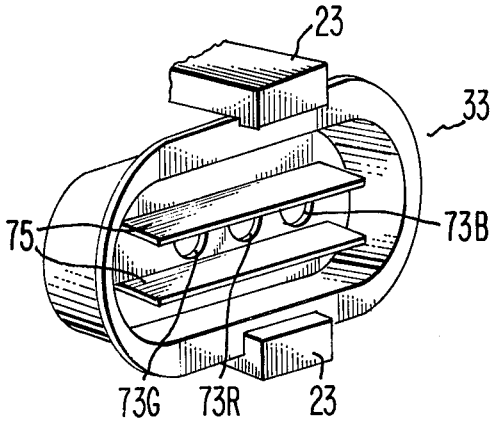
FIG. 6 is a perspective view of an electrode of the gun of FIGS. 4 and 5 including horizontally oriented slats or plates.

The details of the improved gun 19 are shown in FIGS. 4, 5 and 6. For illustration, the inventive improvement is shown as being added to the gun disclosed in U.S. Pat. No. 3,773,554. The gun 19 comprises two glass support rods 23 on which the various grid electrodes are mounted. These electrodes include three equally-spaced co-planar cathodes 25 (one for each beam), a control grid electrode 27, a screen grid electrode 29, a first accelerating and focusing electrode 31, a second accelerating and focusing electrode 33, and a shield cup 35. All of these components are spaced along the glass rods 23 in the order named.

Each cathode 25 comprises a cathode sleeve 37, closed at the forward end by a cap 39 having an end coating 41 of electron emissive material. Each sleeve is supported in a cathode support tube 43. The tubes 43 are supported on the rods 23 by four straps 45 and 47. Each cathode 25 is indirectly heated by a heater coil 49 positioned within the sleeve 37 and having legs 51 welded to heater straps 53 and 55 mounted by studs 57 on the rods 23.

The control and screen grid electrodes 27 and 29 are two closely-spaced (about 0.23 mm. apart) flat plates, each having three apertures 59G, 59R and 59B and 60G, 60R and 60B, respectively, centered with the cathode coatings 41 and aligned with the apertures of the other along a central beam path 20R and two outer beam paths 20G and 20B extending toward the screen 13. The outer beam paths 20G and 20B are equally spaced from the central beam path 20R. Preferably, the initial portions of the beam paths 20G, 20R and 20B are substantially parallel and about 5 gm. apart, with the middle path 20R coincident with the central axis A—A.

The first accelerating and focusing electrode 31 comprises first and second cup-shaped members 61 and 63, respectively, joined together at their open ends. The first cup-shaped member 61 has three medium sized (about 1.5 mm.) apertures 65G, 65R and 65B close to the grid electrode 29 and aligned respectively with the three beam paths 20G, 20R and 20B, as shown in FIG. 5. The second cup-shaped member 63 has three large (about 4 mm.) apertures 67G, 67R and 67B also aligned with the three beam paths.

The second accelerating and focusing electrode 33 is also cup-shaped and comprises a base plate portion 69 positioned close (about 1.5 mm) to the first accelerating electrode 31 and a side wall or flange 71 extending forward toward the tube screen. The base portion 69 is formed with three apertures 73G, 73R and 73B which are preferably slightly larger (about 4.4 mm) than the adjacent apertures 67G, 67R and 67B of electrode 31. The middle aperture 73R is aligned with the adjacent middle aperture 67R (and middle beam path 20R) to provide a substantially symmetrical beam focusing electric field between apertures 67R and 73R when electrodes 31 and 33 are energized at different voltages. The two outer apertures 73G and 73B are slightly offset outwardly with respect to the corresponding outer apertures 67G and 67B, to provide an asymmetrical electric field between each pair of outer apertures when electrodes 31 and 33 are energized, to individually focus each outer beam 20G and 20B near the screen, and also to deflect each outer beam toward the middle beam 20R to a common point of convergence with the middle beam near the screen. In the example shown, the offset of the beam apertures 73G and 73B may be about 0.15 mm.

In order to provide correction for the aforementioned beam flattening as horizontal deflection angle is increased, each beam is predistorted in the gun so that it is vertically defocused at the center of the screen resulting in vertical elongation of the undeflected beam spot. This predistortion, or pre-shaping, of the beams is accomplished by the inclusion of horizontal parallel plates positioned on opposite sides of each beam and extending toward the screen from one of the focusing electrodes. In the embodiment shown in FIGS. 4, 5 and 6, two horizontally oriented parallel slats or plates 75 are attached to an inner wall of the cup-shaped second accelerating and focusing electrode 33. The plates 75 are coextensive with and separated by the electrode apertures 73G, 73R and 73B. The purpose of so positioning the plates 75 is to cause defocusing about vertical axes passing through each of the apertures 73G, 73R and 73B.

Figure 7:
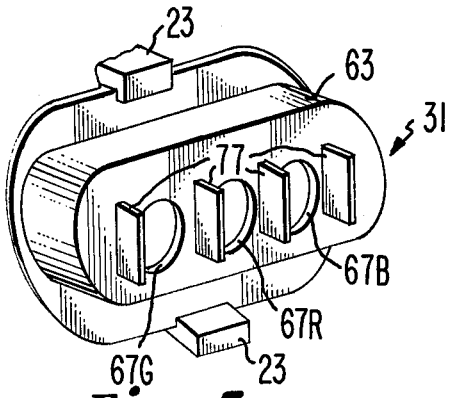
FIG. 7 is a perspective view of another electrode embodiment including vertically oriented plates.

Alternately, rather than defocusing the focusing field about a vertical axis, the focusing field can be overfocused or strengthened about a horizontal axis. Such strengthening can be accomplished by placement of vertically oriented plates 77 on opposite sides of each aperture in the cup-shaped member 63 of the first accelerating and focusing electrode 31 as shown in FIG. 7.

Figure 8:
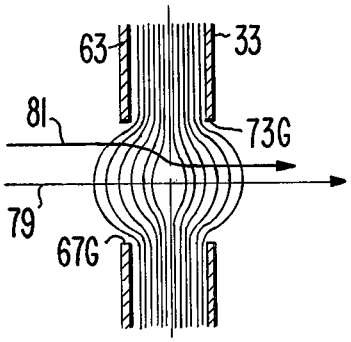
PRIOR ART FIG. 8
FIG. 8 is a schematic view illustrating the focusing and converging electric fields associated with a pair of beam apertures without using plates.
Figure 9:
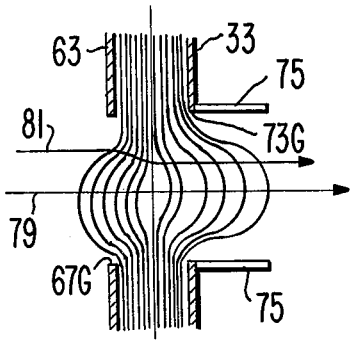
FIG. 9 is a schematic side view showing the focusing and converging electric fields associated with a pair of beam apertures utilizing horizontal plates.
Figure 10:
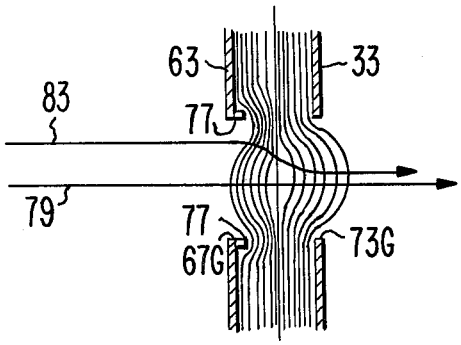
FIG. 10 is a schematic top view showing the focusing and converging electric field associated with a pair of beam apertures utilizing vertical plates.

The concept of the present invention can be better understood with reference to the schematics of FIGS. 8, 9, and 10. FIG. 8 illustrates a vertical cross-section of an electron lens of the prior art formed by the two electrodes 33 and 66 without the plates 75. Electron lens equipotential lines are shown and the effect of the electron lens on two electron paths 79 and 81 is illustrated. Electron path 79 is on the center line of the lens and electron path 81 is off-center. The electron lens has no effect on the center electron path 79 but causes electrons in off-center paths to converge toward the center of the lens. When plates 75 are added to the electrode 33 the equipotential lines are stretched in the direction of the plates 75, as shown in FIG. 9, thereby defocusing or distorting the electrostatic field of the electron lens in the vertical plane passing through the electrodes. This distorting of the electron lens has no effect on the center electron path 79, but reduces the convergence of the off-centered electron paths 81 to the center of the lens. Since the plates 75 only affect an electron beam along the vertical axis, the distortion of the electron lens along this axis provides a planar defocusing which results in an electron beam that is vertically elongated.

In the alternate embodiment wherein vertical plates 77 are positioned between the apertures 67G, 67R and 67B in the electrode 31, the concept changes from defocusing vertically to increased focusing horizontally. As illustrated in FIG. 10, the addition of the plates 77 causes a concentration of equipotential lines which results in increased convergence of an off-centered electron beam path 83. This increased horizontal focusing provides a horizontal concentration of an electron beam so that the resultant beam is again vertically elongated.

Although the present invention has been described with respect to an in line electron gun, it is to be understood that the basic inventive concept of the present invention may also be applied to delta type electron guns, penetration tube guns and focus grill tube guns, to similarly shape electron beams.

It is claimed:

1. In a cathode-ray tube including an evacuated envelope comprising a faceplate and a neck connected by a funnel, a color phosphor screen on the inner surface of said faceplate, a multiapertured color selection electrode spaced from said screen, and electron gun means mounted in said neck for generating and directing a plurality of electron beams along paths through said electrode to said screen, said gun means including a plurality of cathodes and a plurality of grids spaced between said cathodes and said selection electrode, each of said grids having a plurality of apertures therein corresponding to the number of electron beams, and two of said grids forming a plurality of focusing fields corresponding to the number of electron beams, the improvement comprising, at least one of said grids forming a plurality of focusing fields having attached parallel flat plates positioned on opposite sides of its apertures on its screen side, said plates being positioned to distort said plurality of focusing fields to form a noncircular electron beam.

2. In a cathode-ray tube including an evacuated envelope comprising a faceplate and a neck connected by a funnel, a mosaic color phosphor screen on the inner surface of said faceplate, a multiapertured color selection electrode spaced from said screen, and in-line electron gun means mounted in said neck for generating and directing a plurality of electron beams along co-planar paths through apertures in said electrode to said screen, said gun means including a plurality of cathodes and a plurality of apertured grids spaced between said cathode and said selection electrode, two of said grids forming a focusing field, wherein said beams are subjected to vertical and horizontal magnetic deflection fields during operation of said tube for scanning said beams horizontally and vertically over said screen within a deflection zone located in the vicinity of the junction between said neck and said funnel, said electron beams tend to be distorted into a horizontally elliptical shape when they strike the screen as deflection angle increases by the magnetic deflection fields the improvement comprising, at least one of said grids forming a focusing field having attached parallel flat plates positioned on opposite sides of its apertures on its screen side, whereby the focusing field is distorted to at least partially compensate for distortion of the beam in the magnetic deflection field.

3. The tube as defined in claim 2 wherein said at least one grid is the second closest grid to the screen.

4. The tube as defined in claim 3 wherein said plates are positioned one between each pair of adjacent apertures and one outside of each outer aperture of the grid second closest to the screen.

5. The tube as defined in claim 2 wherein said at least one grid is the closest grid to the screen.

6. The tube as defined in claim 5 wherein said plates are positioned above and below the apertures of the grid closest to the screen.

* * * * *